US010808477B2

(12) United States Patent
Knight et al.

(10) Patent No.: US 10,808,477 B2
(45) Date of Patent: Oct. 20, 2020

(54) DOWNHOLE ANNULAR FLOW DIVERTER

(71) Applicant: Centraflow AS, Stavanger (NO)

(72) Inventors: Grant Knight, Stavanger (NO); Nader Behjat, Stavanger (NO); Craig Usher, Blackburn (GB)

(73) Assignee: Centraflow AS, Stavanger (NO)

( * ) Notice: Subject to any disclaimer, the term of this patent is extended or adjusted under 35 U.S.C. 154(b) by 0 days.

(21) Appl. No.: 16/087,894

(22) PCT Filed: Mar. 28, 2017

(86) PCT No.: PCT/NO2017/050075
§ 371 (c)(1),
(2) Date: Sep. 24, 2018

(87) PCT Pub. No.: WO2017/171556
PCT Pub. Date: Oct. 5, 2017

(65) Prior Publication Data

US 2019/0048673 A1 Feb. 14, 2019

(30) Foreign Application Priority Data

Apr. 1, 2016 (NO) ..... 20160522
Aug. 26, 2016 (NO) ..... 20161363

(51) Int. Cl.
*E21B 21/16* (2006.01)
*E21B 33/13* (2006.01)
(Continued)

(52) U.S. Cl.
CPC ..... *E21B 21/16* (2013.01); *E21B 21/08* (2013.01); *E21B 33/13* (2013.01); *E21B 37/00* (2013.01)

(58) Field of Classification Search
CPC ..... E21B 47/12; E21B 47/024; E21B 47/122; E21B 7/06; E21B 7/067; E21B 44/00;
(Continued)

(56) References Cited

U.S. PATENT DOCUMENTS 5,086,842 A 2/1992 Cholet
10,001,007 B2 * 6/2018 Pelletier ..... E21B 47/065
(Continued)

FOREIGN PATENT DOCUMENTS

EP 2383430 11/2011
WO 2015094163 6/2015

OTHER PUBLICATIONS

"Estimating critical velocity to prevent bed development for Horizontal-Inclined Wellbores" presented at the Middle East Drilling Technology Conference and Exhibition, 2007 (SPE/IADC 108005).
(Continued)

*Primary Examiner* — Zakiya W Bates
(74) *Attorney, Agent, or Firm* — Andrus Intellectual Property Law, LLP

(57) ABSTRACT

A device is for directing a fluid flow in an annulus around a pipe string in a horizontal or deviated well. The device has an orientation sensing member adapted to distinguish between the high-side and the low-side of the borehole along the well path. A fluid direction member is adapted to impede the fluid flow in one portion of the annulus so as to at the same time increase the fluid flow in another portion of the annulus; and an activation member for activating the fluid direction member in the well.

17 Claims, 9 Drawing Sheets

(51) Int. Cl.

| | |
|---|---|
| ***E21B 47/12*** | (2012.01) |
| ***E21B 47/022*** | (2012.01) |
| *E21B 21/08* | (2006.01) |
| *E21B 37/00* | (2006.01) |

(58) Field of Classification Search
CPC .. E21B 47/022; E21B 47/02216; E21B 47/09; E21B 47/0905; E21B 47/16; E21B 47/18; E21B 7/061; E21B 7/068
See application file for complete search history.

(56) References Cited

U.S. PATENT DOCUMENTS

| | | | | |
|---|---|---|---|---|
| 2004/0040749 | A1 | 3/2004 | Terry et al. | |
| 2006/0021797 | A1* | 2/2006 | Krueger | E21B 7/062 175/61 |
| 2010/0175923 | A1* | 7/2010 | Allan | E21B 17/1064 175/45 |
| 2014/0262266 | A1 | 9/2014 | Ingold | |

OTHER PUBLICATIONS

International Search Report, PCT/NO2017/050075, dated Jun. 13, 2017.
Written Opinion, PCT/NO2017/050075, dated Jun. 13, 2017.
Norwegian Search Report, Norwegian Patent Application No. 20161363, dated Mar. 24, 2017.
Norwegian Search Report, Norwegian Patent Application No. 20160522, dated Oct. 27, 2016.

* cited by examiner

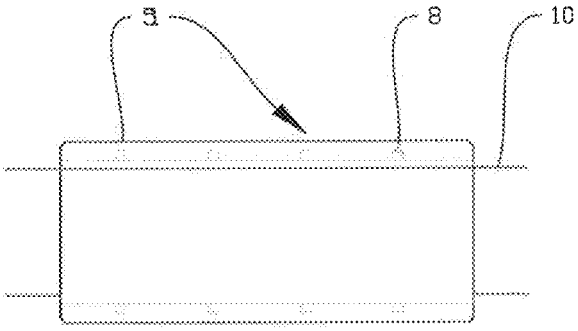
Fig. 3b
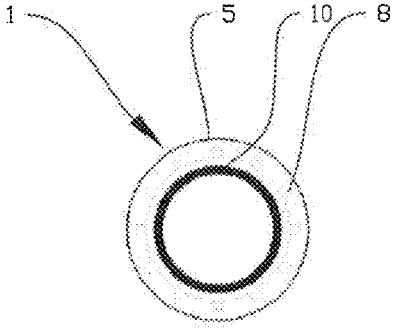
Fig. 3c
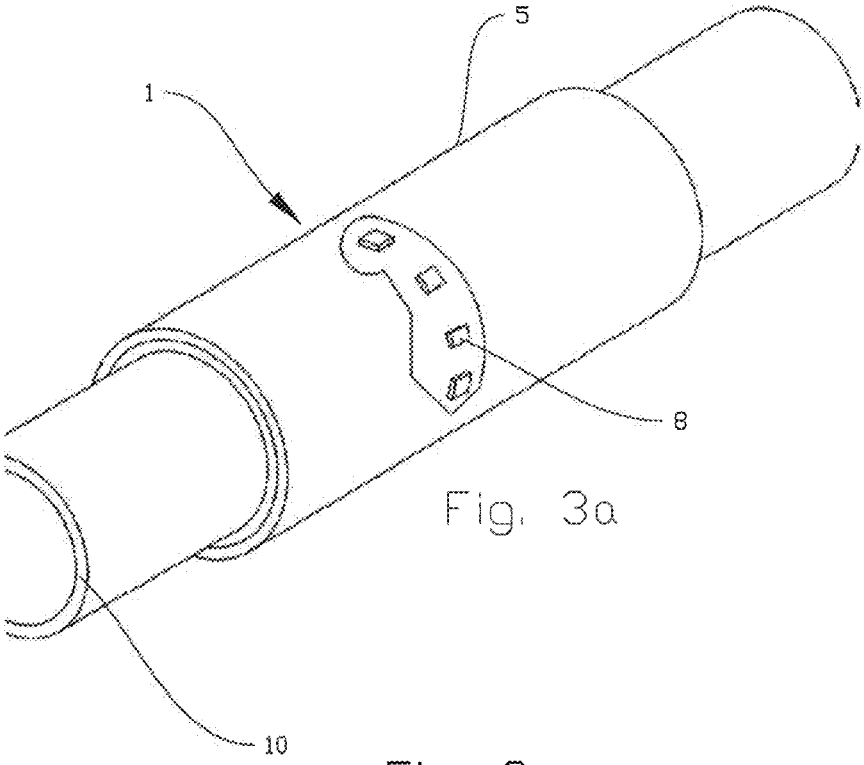
Fig. 3a
Fig. 3

DOWNHOLE ANNULAR FLOW DIVERTER

CROSS-REFERENCE TO RELATED APPLICATIONS

This application is the U.S. national stage application of International Application PCT/NO2017/050075, filed Mar. 28, 2017, which international application was published on Oct. 5, 2017, as International Publication WO 2017/171556 in the English language. The International Application claims priority of Norwegian Patent Application No. 20160522, filed Apr. 1, 2016 and Norwegian Patent Application No. 20161363, filed Aug. 26, 2016. The international application and Norwegian applications are all incorporated herein by reference, in entirety.

FIELD

The present invention relates to a device for directing a fluid flow in an annulus around a pipe string in a horizontal or deviated well. The invention also relates to a pipe string comprising such a device as well as to a method for operating such a device in a well.

BACKGROUND

In horizontal or deviated wells, a stationary bed of cuttings tends to form on the low-side of the borehole when drilling the well due to gravity. This so-called cuttings bed may cause problems such as high drag, difficult hole cleaning and a higher probability of getting the pipe stuck etc. The problems are more pronounced in higher inclination wells and even more so with lower flow velocities of various fluids. Because of the cuttings bed, fluids tend to preferentially flow on the high-side of the borehole, an effect known as "high-side channelling". Another implication of the high-side channelling is that cement tends to flow on the high-side of the borehole when casing strings and liners are to be cemented in place in the well. The low flow on the low-side often causes poor cement bond quality behind the casing on the low-side of the borehole, further potentially leading to well integrity problems. "Bad cement jobs" may have far-reaching effects and high risk impact on well construction.

It is known to provide centralizers around pipe strings in order to increase the stand-off between the pipe string and the low-side of the borehole. However, centralizers typically do not provide a good level of stand-off in high inclination and horizontal wells, and high-side channelling remains a significant problem.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates to a device for directing a fluid flow in an annulus around a pipe string in a horizontal or deviated well, the device comprising:

an orientation sensing member adapted to distinguish between the high-side and the low-side of the borehole along the well path;

a fluid direction member adapted to impede the fluid flow in one portion of the annulus so as to at the same time increase the fluid flow in another portion of the annulus; and an activation member for activating said fluid direction member in the well.

The theory of critical fluid velocities for avoiding cuttings beds was discussed in the paper "Estimating critical velocity to prevent bed development for Horizontal-Inclined Wellbores" presented at the Middle East Drilling Technology Conference and Exhibition, 2007 (SPE/IADC 108005). Reference is made to this paper for an in-depth description of the theory behind cutting beds and critical fluid velocities.

In one embodiment, the device may comprise an orientation member for orienting said fluid direction member in the borehole. It will normally be difficult to predict the orientation of the pipe string when it reaches the depth in the well were the fluid direction member is to be activated. Therefore it may be useful, if needed, to be able to orient the fluid direction member to the preferred orientation before activating it, so as to be able to predict its orientation in the well, and thereby also the direction of the fluid flow.

In most embodiments it will be useful if the fluid direction member is adapted to impede the fluid flow on the high-side of the borehole so as to increase the fluid flow on the low-side of the borehole. This will typically be the case when using the device when cementing a casing string or a liner in the well or when cleaning the annulus around the casing string prior to cementing or when cleaning an annulus around a drill string or a work string. The flow direction member will impede the flow of fluid on the high-side of the borehole while improving, i.e. increasing the velocity of, the fluid flow on the low-side. The theory behind this was discussed in the above-referenced SPE/IADC paper.

In an alternative embodiment, the fluid direction member may in addition or as an alternative be adapted to impede the fluid flow on the low-side of the borehole so as to increase the fluid flow on the high-side of the borehole. This may be useful in gravel packing operations while installing well completion assemblies. In this embodiment, the lower completion assembly most commonly includes sand screens. After installing the lower completion assembly to the required depth, an inner string may be run inside the lower completion assembly to the end of the wellbore and used to pump gravel out the end of the lower completion assembly. If one or more devices according to the first aspect of the invention are activated to partially block the low-side of the wellbore, this would help to divert the flow of gravel up onto the high side of the lower completion assembly and thereby help to achieve full wellbore coverage of gravel around the lower completion assembly. Rather than having a tendency for 'high side channeling', gravel tends to flow on the lower 50% of the wellbore and therefore achieving full coverage on the high-side is a problem.

In its simplest form, the orientation sensing member may be a weight member adapted to self-orient the fluid direction member by means of gravity. The weight member may be an integrated part of the fluid direction member or it may be attached to the fluid direction member. This simple embodiment of the device according to the invention may operate without any sophisticated orientation sensing means and the flow direction member means may as such be its own orientation member.

In an alternative embodiment, the orientation sensing member may be a buoyant member filled or partially filled with air or other buoyant fluids, gases or materials adapted to self-orient the fluid direction member by means of buoyancy. The buoyant member may be an integrated part of the fluid direction member or it may be attached to the fluid direction member. The buoyant member may be designed to run on a low friction surface such as a bearing in order to ensure that the buoyant force overcomes the frictional force required to orientate the member. This embodiment of the device according to the invention may operate without any sophisticated orientation sensing means and the flow direction member means may as such be its own orientation member.

In an alternative embodiment, the orientation sensing member may comprise a gyroscope, and the orientation member may comprise a downhole, electric motor for orienting said fluid direction member in the borehole. A device according to this more sophisticated embodiment, may prove to be more reliable in some applications. In other alternative embodiments, the orientation sensing member may comprise simple gravity-based devices, such as a mercury switch or an electrical switch including conductive fluid.

The fluid direction member may typically comprise one or more segments/parts adapted to protrude, when in the activated position, from the circumference of the pipe string. In one embodiment, the fluid direction member may be an expandable packer or sleeve having a non-uniform radius, or it may be several packer or sleeve segments distributed around the circumference of the pipe string. In the widest sense, the fluid direction member may be any object adapted to be orientated or activated so as to extend from the outer surface of the pipe string and into the annulus around. The fluid direction member may also be a sheath, activatable by means of a cone, axially movable relative to the sheath, the sheath covering a segment of the annulus, such as in the order of 90-180°.

A variety of different activation members may be used to activate the fluid direction member once the pipe string has reached a desired depth/location in the well. In some embodiments the activation member may be operateable by means of one of the following sources:

- hydraulic pressure in the pipe string;
- hydraulic pressure in the annulus;
- chemical reaction, such as an elastomer swelling in contact with water or petroleum.
- a downhole electric motor;
- a biasing member, such as a mechanical spring;
- hydrostatic force;
- a container of compressed fluid; or
- shape memory metals retrieving an original, fluid impeding shape when exposed to temperatures and/or pressure typically present in a well.

The activation member itself may be a valve or an actuator or the like adapted to be operated by one or more of the sources mentioned above.

All of the above-referenced sources of activation may be useful if no de-activation of the fluid direction member is required, i.e. when the fluid direction member may be left in the activated/expanded position in the well after operation. This may be useful when running the fluid direction member into the well as part of a casing string with the aim of improving the distribution of cement in the borehole. The activated fluid direction member may then be left in the well, integrated in the cement. Some of the above-referenced sources, in particular the downhole electric motor, may also be useful in case de-activation of the fluid direction member is desirable. This may typically be the case if the fluid direction member is run into the well on a drill string or work string with the aim of improving cleaning of the annulus around the pipe/work string. For subsequent retrieval of the string from the well, it would likely be advantageous if it is possible to de-activate the fluid direction member into a non-expanded or retracted position. Re-settable packers are known in the art.

As already mentioned above, the pipe string may be a drill string or a work string or it may be a casing string or liner. In a drill string, a device according to the first aspect of the invention may typically be integrated between joints or stands of the string. It may comprise one or more segments, as described above, the one or more segments being attached to a bearing, the bearing allowing the fluid direction member to be kept at a substantially fixed orientation while continuing to rotate drill string. It should also be noted that a plurality of devices according to the first aspect of the invention may be integrated in a pipe string with axial, and optionally circumferential, distance therebetween. In a casing string, a device according to the first aspect of the invention may typically be integrated between joints of casing or 'slipped-on' to a casing joint using a bearing system. When cementing the casing, the device according to the first aspect of the invention may only be activated once the casing string is installed at the correct depth. After activation, cementing operations may be performed. The cementing operation would typically include circulating fluid as 'pre-flush', then spacer fluid, then cement. The flow device according to the first aspect of the invention may remain activated and therefore be cemented into the wellbore. The device according to the invention may also be deployed on a coiled tubing string, then as part of the bottom hole assembly (BHA).

For gravel packing operations, a device according to the first aspect of the invention may typically be integrated between joints of casing or sand screens as a 'sub assembly' as part of the lower completion assembly or alternatively attached externally to a joint of casing or sand screens on the lower completion assembly. The device according to the first aspect of the invention then serves to divert the flow of 'gravel' in the annular space between the lower completion assembly and the wellbore as described above.

In a second aspect, the invention relates to a method for directing a fluid flow in a horizontal or deviated well by means of a device according to the first aspect of the invention, wherein the method comprises the steps of:

- running the device into the well on a pipe string; and
- activating said fluid directing member by means of the activation member when the device has reached a desired depth in the well.

The activation, and optional de-activation, of the fluid directing member as such may be controllable via signal transmission from the surface of the well. The signals may be transferred wirelessly from the surface. In an alternative embodiment, the activation may be automatic in the sense that no signals need to be transferred from the surface for the activation to commence. The activation may be automatically initiated after a certain time, or a downhole indicator/trigger may be embedded in a well construction element, such as in a casing or in a liner, that will be able to communicate locally with a device according to the first aspect of the invention once in the proximity of the trigger. The trigger/indicator may be a RFID tag adapted to communicate with a RFID tag on a device according to the first aspect of the invention. If RFID technology is used, a tag may also be dropped into the casing and pumped down with fluid. When the RFID tag passes the device according to the first aspect of the invention, it may 'tell' the fluid direction member to activate. Alternatively, the device could be designed to recognize a series of pressure pulses either inside the casing or drill pipe or in the annulus. Finally, a series of 'repeaters' could be installed on the outside of the casing to allow an electrical telematics signal to be transmitted from the rig all the way down to the tool.

In one embodiment the device may be run into the well on a drill string or on a work string, and the method may further comprise the step of:

cleaning at least a portion of the annulus by flowing a cleaning fluid past the activated fluid direction member.

In another embodiment the device may be run into the well on a casing string or liner, where the method may further comprise the step of:

cementing at least of portion of the annulus by flowing cement past the activated fluid direction member.

It should also be noted that it may also be useful to clean the annulus around the casing with the aid of a device according the invention prior to cementing. This will ensure a better homogeneity of the subsequent cement or any other fluidised plugging material.

In yet another embodiment, the device may be run into the well as part of a bottom hole assembly, and the method may further comprise the step of:

gravel packing at least a portion of the annulus by flowing a packing slurry past the activated flow direction member.

There is also described herein an embodiment of device for diverting a fluid flow in an annulus around a pipe string similar to the device according to the first aspect of the invention, but where the flow diverter device is not provided with an orientation sensing member. The idea is then that a plurality of such, simplified flow diverters may be axially and circumferentially distributed along a pipe string and activated when the pipe string has reached a desired depth in the well so as to create a spiralling fluid flow along the pipe string. Each of the devices will impede the fluid flow in part of the annulus, but instead of orienting the devices to certain orientation in the borehole, the circumferential and axial distribution of the devices ensures an even improvement of the fluid flow around the full circumference of the pipe string. There is also described a pipe string, such as a drill string, work string, coil tubing or casing or liner string comprising a plurality of such flow diverters distributed axially and circumferentially around the pipe string so as to create a spiralling fluid flow along the axial direction of the pipe string. Activation and optional de-activation of the alternative flow diverter devices may be initiated in a similar way as described above for the devices with the orientation sensing member. The methods described herein for directing a fluid flow in a horizontal of deviated well also apply for a pipe string provided with a plurality of these simplified flow diverter devices.

BRIEF DESCRIPTION OF THE DRAWINGS

In the following are described examples of preferred embodiments illustrated in the accompanying drawings, wherein:

FIG. 3 shows a third embodiment of a device according to the present invention;

DETAILED DESCRIPTION OF THE DRAWINGS

Figure 1B:
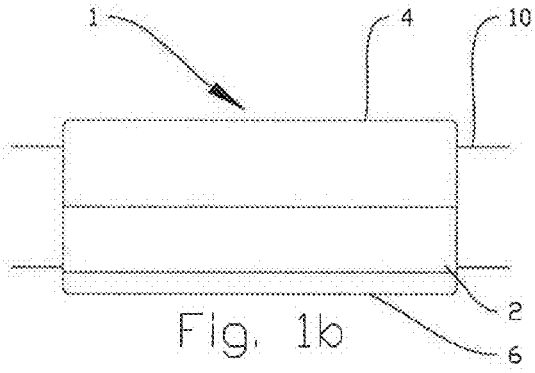
FIGS. 1*a-c* shows a first embodiment of a device according to the present invention.

In the following, the reference numeral 1 will be used to indicate a device according to the first aspect of the invention, whereas the reference numeral 10 will be used to indicate a pipe string comprising a device 1 according to the first aspect of the invention. Identical reference numerals refer to identical or similar features in the drawings. It should also be noted that the drawings are shown schematically and simplified and that the various features in the drawings are not necessarily drawn to scale. In the following the device 1 according to the invention will be referred to as a flow diverter.

Figure 1C:
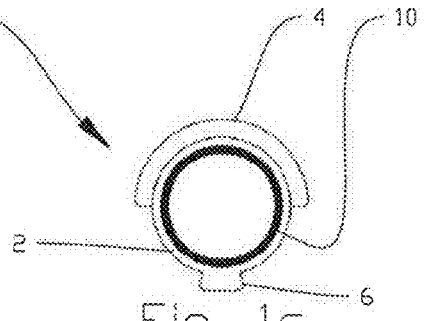
Figure 1A:
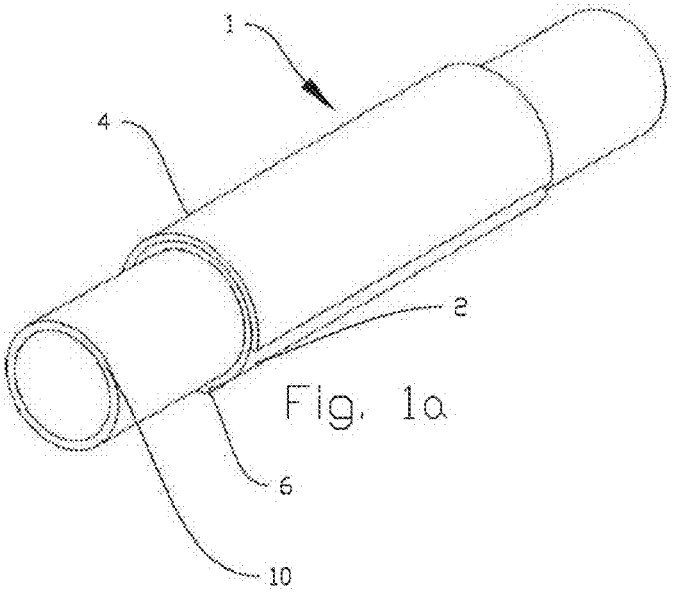

FIGS. 1*a, b and c* show a first embodiment of a flow diverter 1 in a perspective view and in longitudinal and axial cross-sections, respectively. The flow diverter 1 is shown provided on a pipe string 10, wherein only a short portion of the pipe string 10 is shown in the figures for simplicity. The flow diverter 1 is attached to a not shown bearing in order to enable independent rotation of the pipe string 10 relative to the flow diverter 1. The flow diverter 1 is shown comprising a steel base 2 encircling the pipe string 10, and a fluid direction member 4 in the form of a swellable elastomer packer. The swellable elastomer packer 4 covers about half, i.e. a sector of 180°, of the circumference of the pipe string 10 extending radially into a not shown annulus. The steel base 2 is further formed with a weight member 6, in the form of a radial protrusion, ensuring that the flow diverter 1 will self-orient itself due to gravity. The radial protrusion 6 will tend to end up at the low-side of the not shown borehole, further implying that the swellable packer 4, in its activated/extended/swelled position, will impeded the flow of fluids on the high-side of the borehole so as to improve the flow on the low-side, in the area between the elastomer packer 4 and the weight member protrusion 6, of the borehole in order to avoid or significantly reduce the problem of cuttings beds described herein. The steel base 2 with the protrusion 6 thus acts both as an orientation sensing member and as an orientation member. In a more sophisticated embodiment, the orientation sensing member may be a gyroscope, a mercury switch or similar, while the orientation member may be a downhole electrical motor. This first embodiment constitutes a simple and low-cost implementation of the invention. It may be particularly useful in use when there is no need to de-activate the fluid direction member 4, such as for cleaning and/or cementing an annulus outside a casing string or liner. A person skilled in the art will understand that the swellable elastomer packer 4 acts as its own activation member, in that it is activated in contact with a certain fluid, typically water or oil.

Figure 2B:
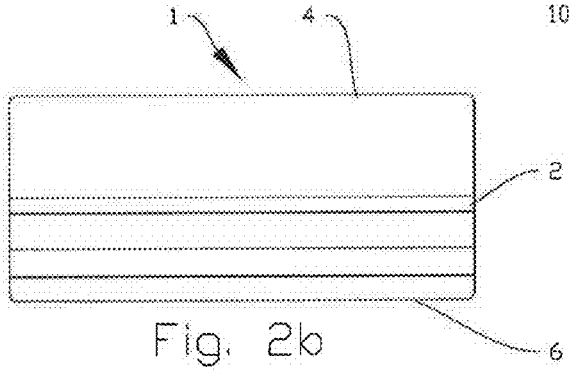
FIG. 2*a-c* shows a second embodiment of a device according to the present invention.
Figure 2C:
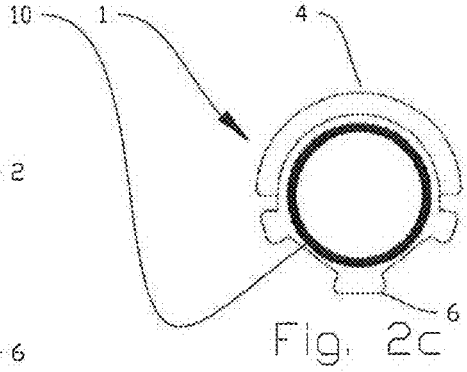
Figure 2A:
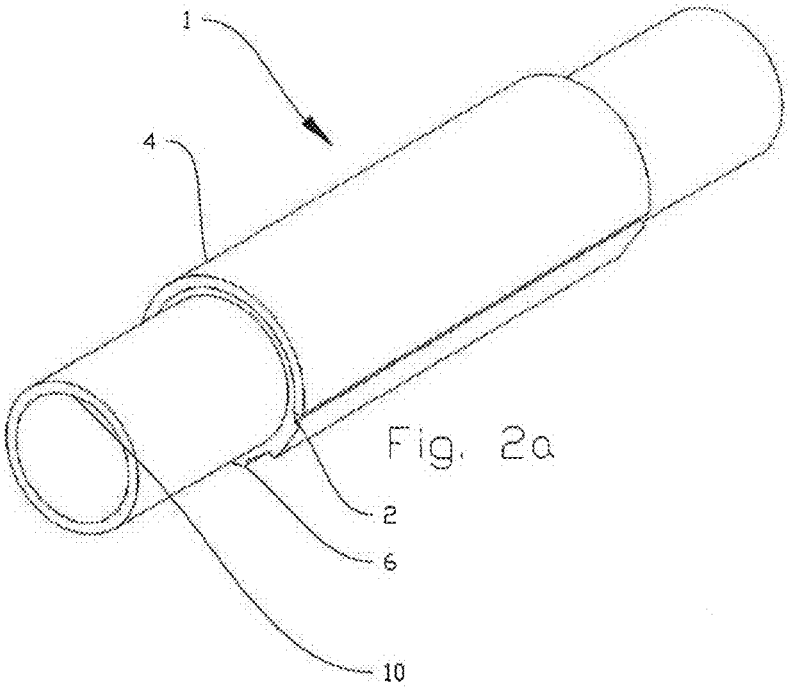

FIGS. 2*a, b* and *c* show a second embodiment of a flow diverter 1 in a perspective view and in longitudinal and axial cross-sections, respectively. The flow diverter differs from the one shown in FIGS. 1*a-c* in that the steel base 2 is formed with three different protrusions 6, acting as weight members for self-orienting the flow diverter 1, similarly to what was described for the first embodiment above, which may be beneficial for providing more weight for self-orienting the fluid direction member 4.

FIGS. 3*a, b* and *c* show a third embodiment of a flow diverter 1 according to the present invention. In the shown embodiment a plurality of smaller buttons/lugs 8 are evenly distributed around the circumference of the pipe 10. The idea is that the flow diverter 1 is 'wrapped' with an elastomer packing element 5. The series of buttons 8 are spaced around the circumference of the pipe string 10. Once the flow diverter 1 is in place in the wellbore, the flow diverter can identify high side, as explained above. It then 'decides' which buttons to activate. In the shown embodiment, there are 12 buttons. The flow diverter would select 4-6 buttons that were most closely aligned with 'high side'. These buttons 8 will then be extended and thereby deform the elastomer packing element 5 on the high-side of the wellbore and force it to contact the wellbore. There may be several rows of buttons of lugs 8 spaced along the length of the pipe string 10 to deform the elastomer packing element 5 over a longer length.

Figure 4:
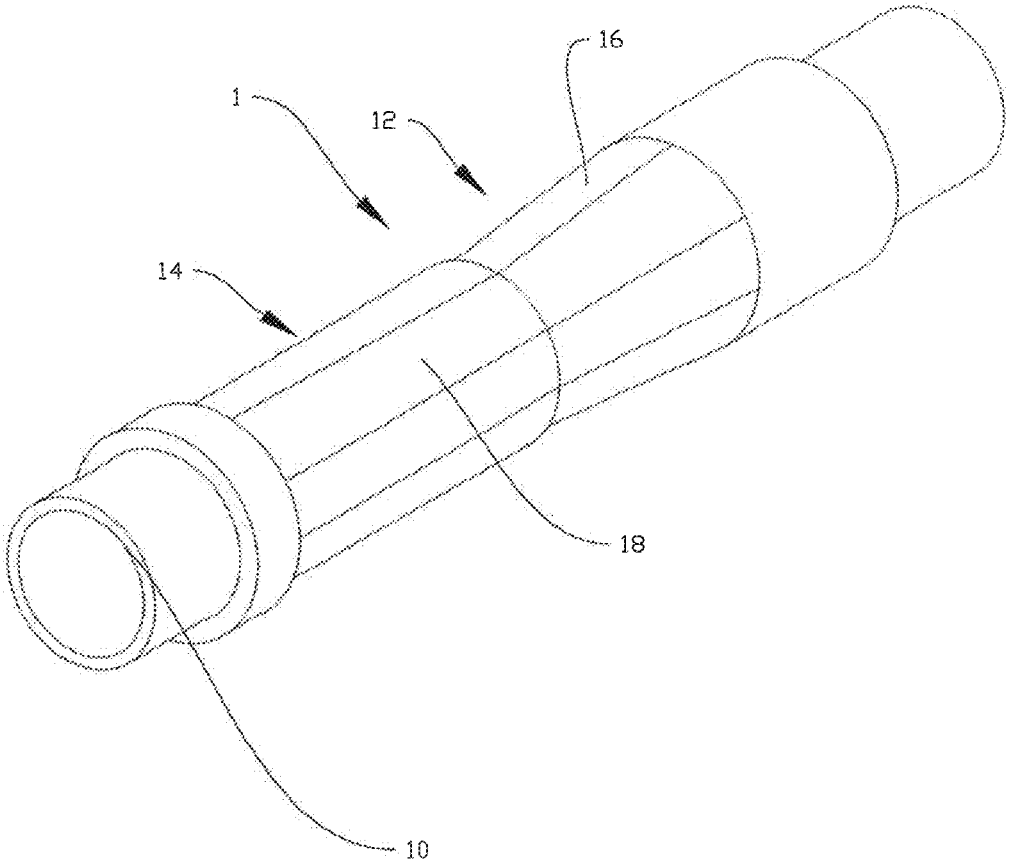
FIG. 4 shows a fourth embodiment of a device according to the present invention in a non-activated position.
Figure 5:
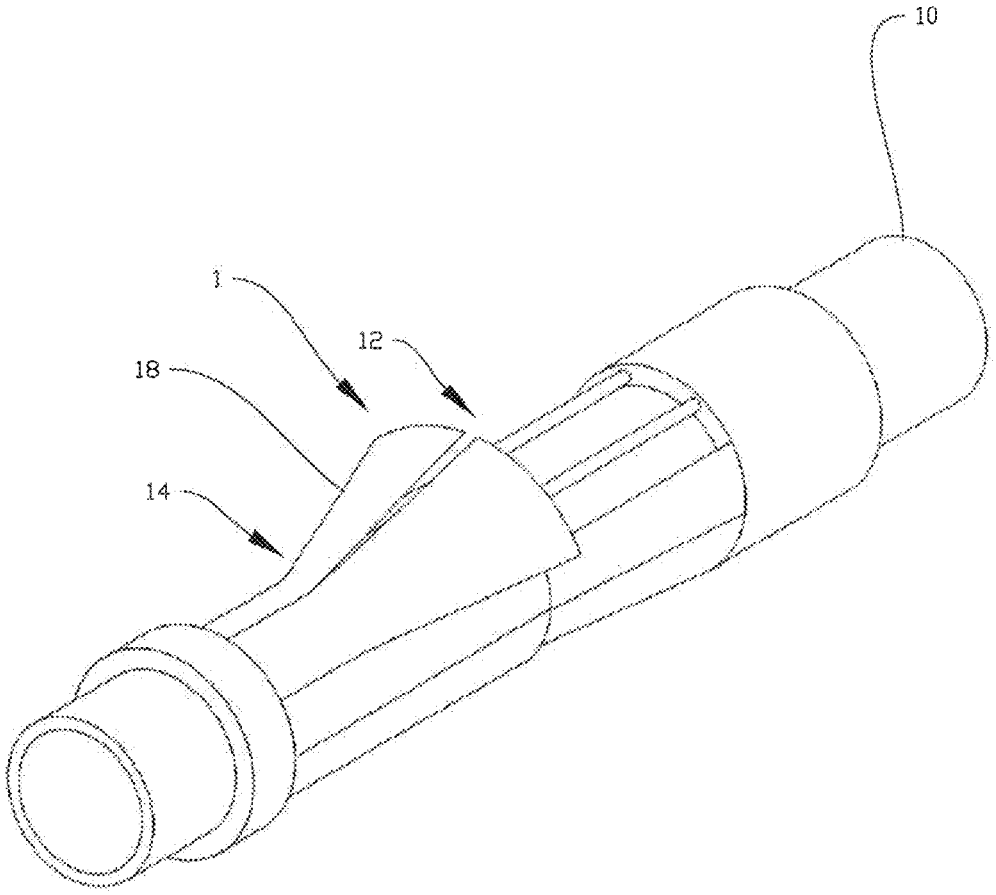
FIG. 5 shows the device from FIG. 4 in an activated position.

FIGS. 4 and 5 show a fourth embodiment of a flow diverter 1 according to the present invention. In the fourth embodiment, a first portion 12 of the flow diverter 1 is moved axially relative to a second portion 14 of the flow diverter 1, whereby a activation member in form of a cone 16 acts a wedge to force a sheath 18 radially out from the pipe string 10 and into the not shown annulus around the pipe string 10 in order to impede the fluid flow in a portion of the annulus. In the shown embodiment, the sheath 18 covers about one fourth, i.e. 90° segment, of the circumference/annulus around the pipe. The relative, axial motion of the two parts 12, 14 of the flow diverter may be initiated by a downhole actuator 28, as shown schematically in FIG. 6. As such, the fourth embodiment may be suitable for operations where de-activation of the flow direction member may be desirable. In the shown embodiment, the cone 16 and 18 comprises different segments that are separately activatable, depending on the sensed orientation of the device 1 in the wellbore as described herein.

Figure 6:
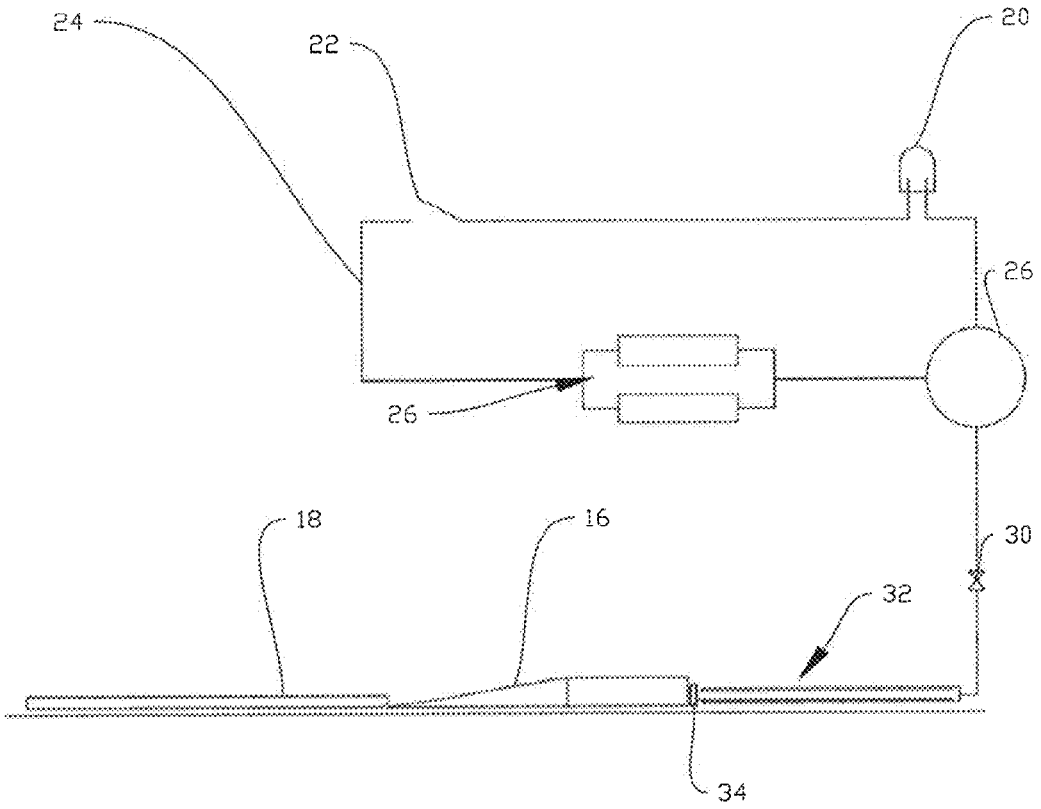
FIG. 6 shows, schematically how activation of a device according to the first aspect of the invention may be initiated.

FIG. 6 shows simplified and schematically how activation and de-activation of the "sheath and cone" embodiment according to FIGS. 4 and 5 may be initiated. A sensor switch 20 receives a signal, by any means described herein, to activate the flow diverter 1 as shown in FIGS. 4 and 5. An operation switch 22 is then activated so as to close an electro-circuit 24 in which a pair of batteries 26 is provided as a power source. The batteries 26 activate a hydraulic actuator 28, hydraulic fluid flowing from the actuator 28 through a valve 30 to a piston 32. The hydraulic force extends a piston rod 34 into contact with the cone 16, forcing the cone 16 in under the sheath 18 to force the sheath 18 radially out from the pipe string as described above. Once the sheath 18 has reached the desired position, the valve 30 may be closed to maintain its activated position. The sheath 18 may subsequently be de-activated/retracted by opening the valve 30 and reversing the activation process.

Figure 7:
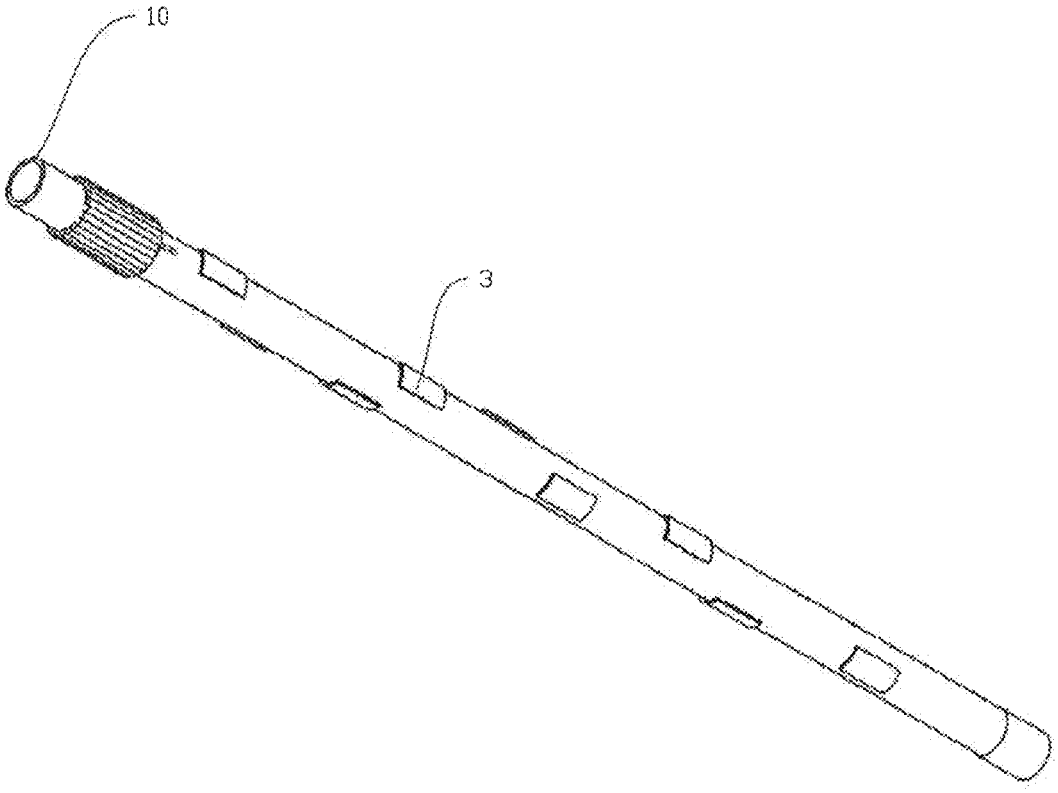
FIG. 7 shows a pipe string with a plurality of alternative flow diverter devices.

FIG. 7 shows a pipe string 10 provided with a plurality of simplified flow diverter devices 3, not provided with any orientation sensing members or orientation members. The simplified flow diverters 3 are distributed axially and circumferentially along the pipe string 10 so as to create an even, spiralling fluid flow along axial direction of the pipe string 10 once activated. Due to the distribution of multiple flow diverters 3 along the pipe string 10, there is no need to sense the orientation or to orient the flow diverters, as the pipe string and flow diverters will always be in the "right" orientation. Activation and optional de-activation of the flow diverters 3 may be initiated as for the flow diverters 1 described herein.

Figure 8:
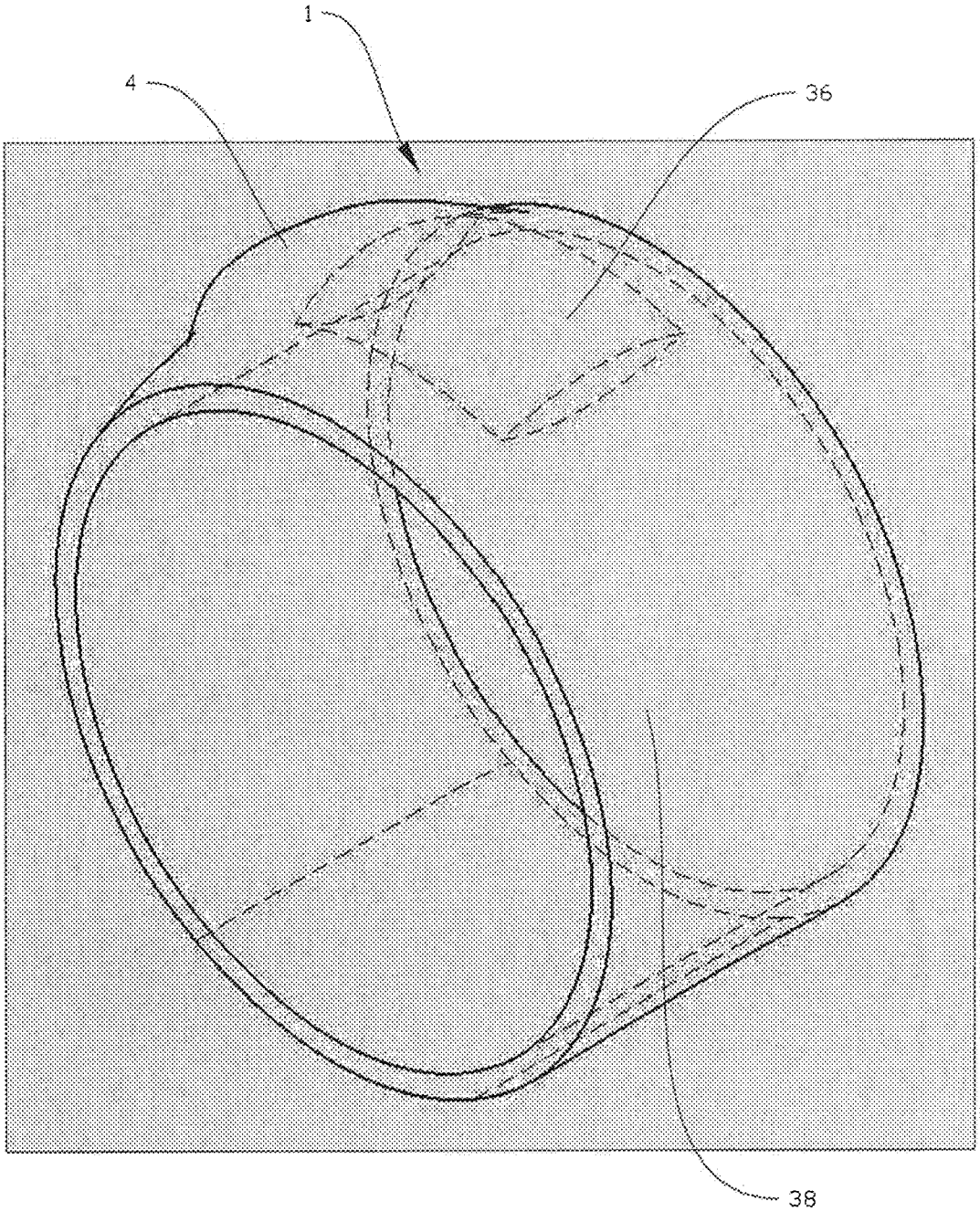
FIG. 8 shows a fifth embodiment of a device according to the present invention.

FIG. 8 shows, schematically and simplified, a fifth embodiment of a flow diverter 1 according to the first aspect of the invention. The flow diverter is provided with an orientation sensing member in the form of a buoyancy member 36. In the simplest form the buoyancy member 36 is a pocket filled with a gas such as air or any other fluid with a sufficiently low specific gravity for the buoyancy member 36 to float up to an upper portion of a not shown annulus. The buoyancy member 36 is included into a sleeve 38, where an upper portion of the sleeve containing the buoyancy member 36 acts as a fluid direction member 4 by protruding into the high-side of the not shown annulus.

Figure 9:
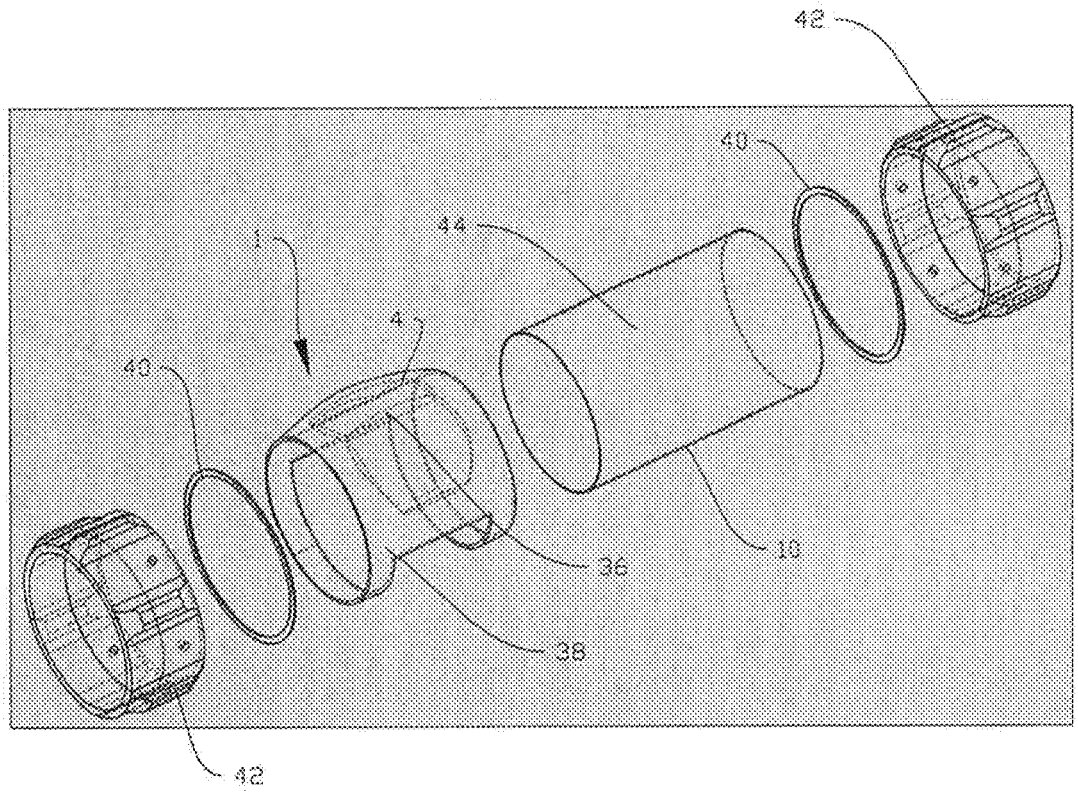
FIG. 9 shows the device according to FIG. 8 included into a pipe string according to the second aspect of the invention.

FIG. 9 shows the embodiment from FIG. 8 as included into a pipe string 10 in an exploded view. The sleeve 38 is rotatably supported on a low-frictional surface 44 of the pipe string 10, while further being connected to two centralizers 42 via axial bearings 40, implying that the sleeve 38 with the buoyancy member 36 may rotate around the pipe string 10 independently of the centralizers 42. It may be useful to use centralizers 42 in combination with the other flow diverters 1 discussed herein in order to provide an improved stand-off between the pipe string 10 and the wall of the borehole.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A device for directing a fluid flow in an annulus around a pipe string in a horizontal or deviated well having a borehole defining a well path, the device comprising:

an orientation sensing member adapted to distinguish between a high-side and a low-side of the borehole along the well path;

a fluid direction member adapted to impede the fluid flow in one portion of the annulus so as to at the same time increase the fluid flow in another portion of the annulus; and said one portion being one of the low side and high side of the borehole and said another portion being a different one of the low side and high side;

wherein the orientation sensing member is a buoyancy member adapted to self-orient the fluid direction member via buoyancy.

2. The device according to claim 1, wherein the device further comprises an orientation member for orienting the fluid direction member in the borehole.

3. The device according to claim 1, wherein the fluid direction member is adapted to impede the fluid flow on the high-side of the borehole so as to increase the fluid flow on the low-side of the borehole.

4. The device according to claim 1, wherein the fluid direction member is adapted to impede the fluid flow on the low-side of the borehole so as to increase the fluid flow on the high-side of the borehole.

5. The device according to claim 1, wherein the orientation sensing member is a weight member adapted to self-orient the fluid direction member via gravity.

6. The device according to claim 1, wherein the fluid direction member is an expandable packer or sleeve having a non-uniform radius.

7. The device according to claim 1, further comprising an activation member for activating the fluid direction member in the well.

8. The device according to claim 7, wherein the activation member is operateable via one of the following sources:

hydraulic pressure in the pipe string;
hydraulic pressure in the annulus;
chemical reaction;
a downhole electric motor;
a biasing member;
hydrostatic force;
a container of compressed fluid; or
shape memory metals.

9. A pipe string comprising:

a device for directing a fluid flow in an annulus around a pipe string in a horizontal or deviated well having a borehole defining a well path, the device comprising:

an orientation sensing member adapted to distinguish between a high-side and a low-side of the borehole along the well path;

a fluid direction member adapted to impede the fluid flow in a first one of the high-side and low-side of the borehole so as to at the same time increase the fluid flow in a second one of the high-side and low-side of the borehole; and said one portion being one of the low side and high side of the borehole and said another portion being a different one of the low side and high side;

wherein the orientation sensing member is a buoyancy member adapted to self-orient the fluid direction member via buoyancy.

10. The pipe string according to claim 9, wherein the pipe string is a drill string or work string.

11. The pipe string according to claim 9, wherein the pipe string is a casing string or liner.

12. The pipe string according to claim 9, further comprising an activation member for activating the fluid direction member in the well.

13. A method for directing a fluid flow in a horizontal or deviated well via a device for directing a fluid flow in an annulus around a pipe string in a horizontal or deviated well having a borehole defining a well path, the device comprising:

an orientation sensing member adapted to distinguish between a high-side and a low-side of the borehole along the well path;

a fluid direction member adapted to impede the fluid flow in one portion of the annulus so as to at the same time increase the fluid flow in another portion of the annulus;

said one portion being one of the low side and the high side of the borehole and said another portion being a different one of the low side and high side; and wherein the orientation sensing member is a buoyancy member adapted to self-orient the fluid direction member via buoyancy;

wherein the method comprises:

running the device into the well on a pipe string.

14. The method according to claim 13, wherein the device further comprises an activation member for activating the fluid direction member in the well, and wherein the method further comprises activating the fluid direction member via the activation member when the device has reached a desired depth in the well.

15. The method according to claim 14, wherein the device is run into the well on a drill string or on a work string, and wherein the method further comprises the step of:

cleaning at least a portion of the annulus by flowing a cleaning fluid past the activated fluid direction member.

16. The method according to claim 14, wherein the device is run into the well on a casing string, and wherein the method further comprises:

cementing at least of portion of the annulus by flowing cement past the activated fluid direction member.

17. The method according to claim 14, wherein the device is run into the well as part of a bottom hole assembly, and wherein the method further comprises:

gravel packing at least a portion of the annulus by flowing a slurry past the activated flow direction member.

* * * * *